US008978624B2

(12) United States Patent
Kamada et al.

(10) Patent No.: US 8,978,624 B2
(45) Date of Patent: Mar. 17, 2015

(54) VIBRATION DAMPING INSULATOR FOR FUEL INJECTION VALVE

(75) Inventors: Akira Kamada, Toyota (JP); Natsuki Sugiyama, Toyota (JP); Tomokazu Sumida, Akaiwa (JP); Seizo Watanabe, Akaiwa (JP)

(73) Assignees: Toyota Jidosha Kabushiki Kaisha, Toyota (JP); Uchiyama Manufacturing Corp., Okayama (JP)

( * ) Notice: Subject to any disclaimer, the term of this patent is extended or adjusted under 35 U.S.C. 154(b) by 255 days.

(21) Appl. No.: 13/700,208

(22) PCT Filed: Jul. 30, 2010

(86) PCT No.: PCT/JP2010/062959

§ 371 (c)(1),
(2), (4) Date: Nov. 27, 2012

(87) PCT Pub. No.: WO2012/014326

PCT Pub. Date: Feb. 2, 2012

(65) Prior Publication Data

US 2013/0167807 A1 Jul. 4, 2013

(51) Int. Cl.
*F02M 61/14* (2006.01)

(52) U.S. Cl.
CPC ..... *F02M 61/14* (2013.01); *F02M 2200/306* (2013.01); *F02M 2200/858* (2013.01)
USPC ..... 123/470; 239/600; 277/593; 277/598

(58) Field of Classification Search
CPC ..... F02M 61/14; F02M 69/042
USPC ..... 123/470; 239/533.11, 533.13, 600; 277/591, 594, 598
See application file for complete search history.

(56) References Cited

U.S. PATENT DOCUMENTS 3,841,277 A 10/1974 Schäfer
4,362,139 A 12/1982 Isobe et al.

(Continued)

FOREIGN PATENT DOCUMENTS

JP A-08-246994 9/1996
JP A-09-195891 7/1997

(Continued)

OTHER PUBLICATIONS

Office Action issued in U.S. Appl. No. 13/635,812, issued Nov. 7, 2013.

(Continued)

*Primary Examiner* — Noah Kamen
*Assistant Examiner* — Grant Moubry
(74) *Attorney, Agent, or Firm* — Oliff PLC

(57) ABSTRACT

A fuel injection valve is mounted in a cylinder head by being inserted in an insertion hole provided in the cylinder head. A shoulder section is provided at the inlet portion of the insertion hole to be expanded in an annular shape. The fuel injection valve is provided with a stepped section expanded in diameter in a tapered manner to have a tapered surface facing the shoulder section. A vibration insulator is disposed between the stepped section and the shoulder section. The vibration insulator is provided with a circular annular tolerance ring making contact with the tapered surface of the fuel injection valve. A circular annular sleeve section coaxial with the tolerance ring is integrally formed on the tolerance ring to extend from the surface of a portion of the tolerance ring, the portion not facing the tapered surface of the fuel injection valve.

11 Claims, 7 Drawing Sheets

(56) References Cited

U.S. PATENT DOCUMENTS

| | | | | |
|---|---|---|---|---|
| 4,647,012 | A | 3/1987 | Gartner | |
| 5,046,469 | A * | 9/1991 | Gmelin | 123/470 |
| 5,954,343 | A | 9/1999 | Sumida et al. | |
| 6,112,722 | A | 9/2000 | Barnhart et al. | |
| 6,263,863 | B1 | 7/2001 | Giovannini et al. | |
| 6,718,949 | B2 | 4/2004 | Gmelin | |
| 6,848,425 | B2 | 2/2005 | Raimann | |
| 6,866,026 | B2 | 3/2005 | Mickelson | |
| 6,899,087 | B2 | 5/2005 | Norgauer | |
| 7,373,925 | B2 | 5/2008 | Reiter et al. | |
| 7,559,312 | B2 | 7/2009 | Brauneis et al. | |
| 7,600,502 | B2 | 10/2009 | Welzmueller et al. | |
| 7,827,964 | B2 | 11/2010 | Chern et al. | |
| 7,832,376 | B2 | 11/2010 | Mueller et al. | |
| 2004/0020470 | A1 | 2/2004 | Norgauer | |
| 2008/0302336 | A1 | 12/2008 | Fuerst et al. | |
| 2009/0071445 | A1 | 3/2009 | Mueller et al. | |
| 2009/0235898 | A1 | 9/2009 | Short | |
| 2013/0167807 | A1 | 7/2013 | Kamada et al. | |

FOREIGN PATENT DOCUMENTS

| | | | |
|---|---|---|---|
| JP | A-11-210885 | | 8/1999 |
| JP | A-2001-324021 | | 11/2001 |
| JP | A-2004-506136 | | 2/2004 |
| JP | A-2004-204991 | | 7/2004 |
| JP | A-2007-247893 | | 9/2007 |
| JP | A-2008-516133 | | 5/2008 |
| JP | A-2008-128343 | | 6/2008 |
| JP | A-2008-256193 | | 10/2008 |
| JP | B2-4191734 | | 12/2008 |
| JP | A-2010-106758 | | 5/2010 |
| JP | A-2010-106759 | | 5/2010 |
| JP | A-2010-127193 | | 6/2010 |
| JP | A-2010-159726 | | 7/2010 |
| WO | WO 2005/021956 | A1 | 3/2005 |
| WO | WO 2011/121728 | A1 | 10/2011 |
| WO | WO 2012/014326 | A1 | 2/2012 |

OTHER PUBLICATIONS

Notice of Allowance issued in U.S. Appl. No. 13/635,812 dated Mar. 14, 2014.

* cited by examiner

VIBRATION DAMPING INSULATOR FOR FUEL INJECTION VALVE

FIELD OF THE DISCLOSURE

The present invention relates to a vibration insulator for a fuel injection valve. The vibration insulator is configured to damp vibration that occurs in the fuel injection valve, which injects fuel into an internal combustion engine.

BACKGROUND OF THE DISCLOSURE

Conventionally, internal combustion engines of one type in which fuel is injected into the inside of a combustion chamber, that is, internal combustion engines of the in-cylinder injection type, for example, have the distal end portion of a fuel injection valve inserted into and supported by an insertion hole of a cylinder head and have the proximal end portion of the fuel injection valve inserted into and supported by a delivery pipe (a fuel injection valve cup), whereby the fuel injection valve is provided across the cylinder head and the delivery pipe. When a fuel pressure supplied to the fuel injection valve through the delivery pipe has changed due to injection or stopping of the fuel, vibration based on the change in fuel pressure and vibration accompanying the operation of the fuel injection valve usually occur to the above fuel injection valve. For this reason, it is often the case that a vibration insulator to absorb and damp such vibration of a fuel injection valve is attached between the fuel injection valve and an insertion hole of a cylinder head.

On the other hand, the cylinder head and the delivery pipe are originally parts of separate bodies. Therefore, changes in the relative positions thereof, which are caused by, for example, tolerances associated with production or processing of these parts, tolerances associated with assembly in the production, thermal deformation, and various vibrations that accompany the operation of the internal combustion engine, are unavoidable. That is, the axis of the fuel injection valve provided across the cylinder head and the delivery pipe becomes inclined relative to the axis of the insertion hole of the cylinder head, whereby positions at which the fuel injection valve is supported by the cylinder head and the delivery pipe deviate from correct positions. Further, such positional deviation causes problems such as partial slack of an O-ring at the proximal end of the fuel injection valve, the O-ring serving to prevent fuel leakage between the fuel injection valve and the delivery pipe (fuel injection valve cup). Therefore, the positional deviation may possibly cause fuel leakage.

For this reason, insulators designed to not only absorb and damp vibration of the fuel injection valve but also reduce the influence of such inclination of the axis of the fuel injection valve have been proposed, and an insulator described in Patent Document 1 is known as one example thereof. The insulator described in Patent Document 1, as shown in FIG. 12, includes an annular adjustment element 60 sandwiched between a shoulder section 54 of a cylinder head 51 and a tapered stepped section 57 of a fuel injection valve 55, the diameter of which is enlarged in a tapered shape to face the shoulder section 54. While an injection nozzle 56 of the fuel injection valve 55 is arranged by being inserted into the insertion hole 52 (a receiving hole) of the cylinder head 51, the shoulder section 54 of the cylinder head 51 has an opening into a side wall 53 of the insertion hole 52. The adjustment element 60 has a first leg 61 extending along the shoulder section 54 of the insertion hole 52, and a second leg 62 extending along the tapered stepped section 57 of the fuel injection valve 55. Additionally, a structure elastically supporting the fuel injection valve 55 with respect to the cylinder head 51 is obtained by having the first leg 61 in surface contact with the shoulder section 54 of the insertion hole 52, and having the second leg 62 in surface contact with the tapered stepped section 57 of the fuel injection valve 55.

According to the thus configured insulator, even when the axis C2 of the fuel injection valve 55 has deviated from the centered position between the insertion hole 52 of the cylinder head 51 and a delivery pipe in assembly, the first leg 61 moves along the shoulder section 54 of the insertion hole 52 due to a force generated by the second leg 62, which flexes in accordance with the tapered stepped section 57 of the fuel injection valve 55. This serves to appropriately compensate the positional relations of the fuel injection valve 55 with the insertion hole 52 and the delivery pipe.

When the internal combustion engine is operated, a high pressing force based on the above described fuel pressure is applied to the second leg 62 of the adjustment element 60 through the tapered stepped section 57 of the fuel injection valve 55. At this time, a force toward the shoulder section 54 of the insertion hole 52 and a force toward the outer circumference of the adjustment element 60 are applied to the second leg 62 of the adjustment element 60 from the tapered stepped section 57 of the fuel injection valve 55 in a manner corresponding to the tapering angle of the tapered stepped section 57.

PRIOR ART DOCUMENT

Patent Document

Patent Document 1: Japanese Patent No. 4191734

SUMMARY OF THE INVENTION

Problems that the Invention is to Solve

Out of these forces, in FIG. 12, the force from the fuel injection valve 55 toward the outer circumference of the adjustment element 60 acts in a manner enlarging the ring diameter of the adjustment element 60, and therefore, may possibly warp the second leg 62 toward the outer circumference thereof. Particularly, when the second leg 62 has been warped such that the opening of the second leg 62 is enlarged, a position at which the second leg 62 supports the tapered stepped section 57 of the fuel injection valve 55 shifts toward the inner circumference of the second leg 62 having a slope along the tapered stepped section 57. That is, since the vertical position of the fuel injection valve 55 with respect to the cylinder head 51 shifts, and results in such consequences as change of the fuel injection position, whereby there is a risk that the most suitable combustion state cannot be maintained.

Accordingly, it is an objective of the present invention to provide a vibration insulator for a fuel injection valve, the a vibration insulator being capable of, even when an internal combustion engine is in operation, not only performing the function of damping vibration of the fuel injection valve but also suitably maintaining the fuel injection position of the fuel injection valve.

Means for Solving the Problems

In order to solve the above problem, the present invention provides a vibration insulator for a fuel injection valve that is configured to damp vibration that occurs to the fuel injection valve. The fuel injection valve is mounted on the cylinder head while being inserted into the insertion hole provided in the cylinder head. While the shoulder section is annularly formed in an inlet portion of the insertion hole to have an opening, the fuel injection valve includes a stepped section, the diameter of which is enlarged in a tapered manner to have a tapered surface facing the shoulder section. The vibration insulator is located between the stepped section and the shoulder section, and the vibration insulator includes a circular ring-like tolerance ring abutting the tapered surface. The above described vibration insulator for a fuel injection valve is characterized in that the tolerance ring has a sleeve section formed integrally therewith in a manner extending from a surface in a part, of the tolerance ring, that faces away from the tapered surface, the sleeve section having a circular ring-like shape that is concentric with the tolerance ring.

According to this configuration, the stiffness of the tolerance ring itself is increased by the sleeve section provided integrally thereto to extend therefrom, whereby the durability of the tolerance ring against a force that is received thereby from the tapered surface of the fuel injection valve and acts in a manner enlarging the opening of the tolerance ring is improved. Thus, warping of the tolerance ring is prevented from occurring, and a position at which the tapered surface of the fuel injection valve abuts the tolerance ring is maintained. That is, the fuel injection position of the fuel injection valve with respect to the combustion chamber is suitably maintained, and the combustion state is appropriately maintained as well.

The vibration insulator may include an elastic member arranged between the tolerance ring and the shoulder section. In order to damp vibration that occurs in the fuel injection valve, the elastic member is formed in a circular ring-like shape corresponding to the bottom surface of the tolerance ring. The sleeve section may extend from the bottom surface of the tolerance ring toward the shoulder section along the elastic member, and may be formed with the extending length of the sleeve section being shorter than the distance between the bottom surface of the tolerance ring and the above shoulder section.

This configuration brings the sleeve section into contact with the shoulder section when the elastic member has deformed by receiving a strong pressing force from the fuel injection valve. Therefore, excessive deformation of the elastic member, which might plastically deform when having deformed greatly, is restricted. That is, it is made possible to use the elastic member with an amount of deformation (height) thereof being limited within a range that permits the elastic member to elastically deform. As a result, the elasticity of the elastic member is suitably maintained, and the function of absorbing and damping vibration by means of the elasticity thereof is maintained.

A coil spring helically arranged in a manner corresponding to the circular ring-like shape of the elastic member may be embedded in the elastic member. The sleeve section, which extends from the bottom surface of the tolerance ring, may be formed with the extending length of the sleeve section being shorter than the diameter of the helix of the coil spring.

This configuration restricts excessive deformation of the elastic member, the elasticity of which is adjusted by the coil spring. In other words, this configuration allows the elastic member to be used within the extent (in height) that permits the elastic member to elastically deform. As a result, the elasticity of the elastic member is suitably maintained, and the function of absorbing and damping vibration by means of the elasticity thereof is maintained.

The sleeve section may be provided toward the outer circumference of the elastic member.

This configuration causes the elastic member, which tends to deform in a manner radially enlarging when being pressed, to press the sleeve section toward the outer circumference. On the other hand, when the tapered surface of the fuel injection valve presses the tolerance ring while abutting the tolerance ring, the tolerance ring receives a force that acts in a direction that enlarges the opening of the tolerance ring. That is, the tolerance ring receives outward-acting forces in both of the surface thereof facing the tapered surface of the fuel injection valve and the sleeve section, respectively. On this basis, as compared to a case, for example, where the tolerance ring receives an outward-acting force only in the surface thereof facing the tapered surface of the fuel injection valve, warping of the tolerance ring is prevented from occurring. This makes it possible to maintain the position at which the tapered surface of the fuel injection valve abuts the tolerance ring. As a result, the fuel injection position of the fuel injection valve with respect to the combustion chamber is suitably maintained, whereby the most suitable combustion state is maintained.

A surface of the sleeve section that faces the elastic member may be formed into a shape that follows the external form of the helix of the coil spring.

According to this configuration, a force from the elastic member, when the elastic member is pressed to deform toward the outer circumference, is more likely to be transmitted to the sleeve section without being dispersed. Therefore, the elastic member, when going to deform, presses the sleeve section with a stronger force toward the outer circumference. As a result, warping of the tolerance ring, which might be caused by a force received by the tolerance ring from the tapered surface of the fuel injection valve, is suppressed to a greater degree. In other words, it is made possible to maintain the position at which the tapered surface of the fuel injection valve abuts the tolerance ring.

The sleeve section may be provided toward each of the inner circumference and the outer circumference of the elastic member.

According to this configuration, reactive forces that a pressing force from the fuel injection valve causes on the elastic member inserted between an inner circumferential sleeve section and an outer circumferential sleeve section of the tolerance ring act toward the tolerance ring. As a result, even when the tolerance ring is pressed by the fuel injection valve, the position of the tolerance ring with respect to the shoulder section is maintained. On this basis, the fuel injection position of the fuel injection valve with respect to the combustion chamber is suitably supported maintained by the tolerance ring. The most suitable combustion state is maintained as well.

The distance between the inner circumferential sleeve section and the outer circumferential sleeve section may be set to become wider toward the shoulder section from the bottom surface of the tolerance ring.

According this configuration, reactive forces caused on the elastic member by a pressing force from the fuel injection valve, which act toward the inner circumference and the outer circumference, are converted into reactive forces resisting the pressing force from the fuel injection valve in accordance with the slope angles of the inner circumferential sleeve section and the outer circumferential sleeve section. These forces act to maintain the position of the tolerance ring with respect to the shoulder section. This also serves to suitably maintain, with respect to the combustion chamber, the fuel injection position of the fuel injection valve supported by the tolerance ring. The most suitable combustion state is maintained as well.

The sleeve section may be provided toward the inner circumference of the elastic member.

According to this configuration, the stiffness of the tolerance ring is improved also by the sleeve section, which extends from the inner circumference. Therefore, improvement in durability of the tolerance ring against a force that is received by the tolerance ring from the tapered surface of the fuel injection valve and acts to enlarge the opening of the tolerance ring is enabled.

The vibration insulator may include an elastic member arranged between the tolerance ring and the shoulder section. The elastic member is formed in a circular ring-like shape corresponding to the bottom surface of the tolerance ring in order to damp vibration that occurs to the fuel injection valve. The sleeve section is extended out to a position facing the surface, of the cylinder head, that has the insertion hole opened therein. The elastic member may be used to provide a predetermined distance between the sleeve section and the surface of the cylinder head.

This configuration also improves the stiffness of the tolerance ring by means of the sleeve section. Thus, improvement in durability of the tolerance ring against a force that is received by the tolerance ring from the tapered surface of the fuel injection valve and acts to enlarge the opening of the tolerance ring is enabled. Furthermore, when the elastic member is deformed into a crushed form, the sleeve section of the tolerance ring abuts the cylinder head. Therefore, excessive deformation of the elastic member is restricted, and it is made possible to use the elastic member within the extent (in height) that permits the elastic deformation thereof. This makes it possible be suitably maintained the elasticity of the elastic member and to maintain the function of absorbing and damping vibration by means of the elasticity.

The vibration insulator may further include a metal plate having a circular ring-like portion located between the elastic member and the shoulder section. The metal plate may be formed into a state pinching the tolerance ring and the elastic member together from the inner circumference of the tolerance ring.

According this configuration, the relative position of the tolerance ring, which is not easy to be strongly joined to the elastic member, with respect to the elastic member is defined by the plate from the inner circumference. This makes it possible to facilitate appropriate stacking of the tolerance ring onto the elastic member. As a result, improvement in feasibility of this vibration insulator is enabled.

The outer circumferential edge of the metal plate may be molded into a shape having a burr generated thereon, the burr having been cut upward toward the elastic member.

According to this configuration, the size of the shoulder section formed on the insertion hole of the cylinder head is formed into the requisite minimum size that enables deviation of the axis of the fuel injection valve from the centered position to be compensated by movement of the vibration insulator.

The tolerance ring may be formed of a metal having the same level of hardness as the housing of the fuel injection valve.

According to this configuration, the pressing force that acts on the fuel injection valve is distributed equally between the tapered surface of the fuel injection valve and the surface of a part, of the tolerance ring, that faces the tapered surface of the fuel injection valve. Therefore, compensating movement that is performed by the tolerance ring in response to the deviation of the axis of the fuel injection valve from the centered position is suitably performed.

DETAILED DESCRIPTION OF THE PREFERRED EMBODIMENTS

First Embodiment

FIGS. 1 to 5 illustrate a vibration insulator according to a first embodiment of the present invention.

Figure 1:
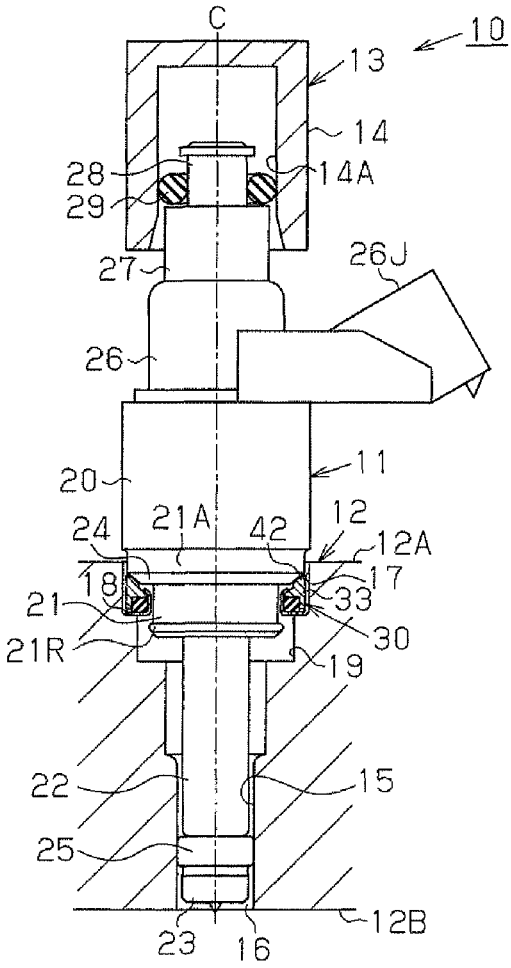
FIG. 1 is a diagram schematically showing the outline of a fuel injection system to which a first embodiment of a vibration insulator according to the present invention is applied.
Figure 2:
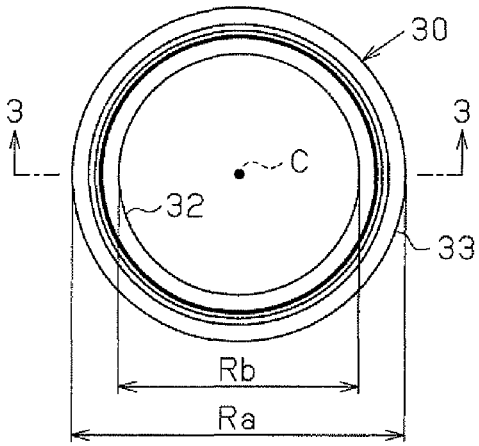
FIG. 2 is a plan view showing a planer structure of the vibration insulator of FIG. 1.
Figure 3:
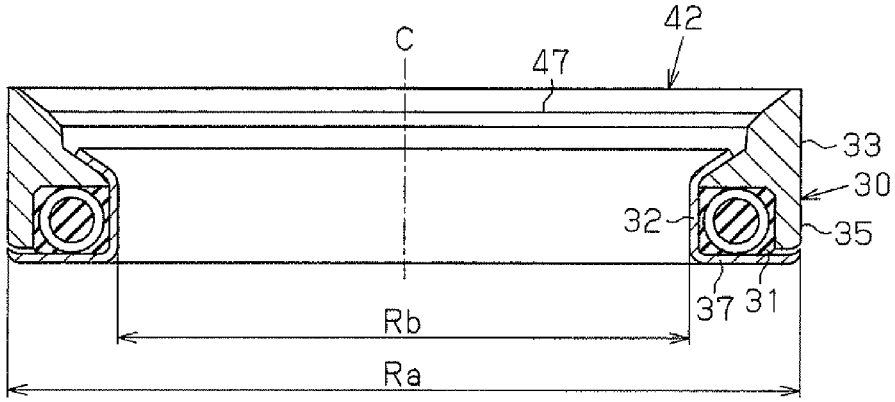
FIG. 3 is a cross-sectional view showing a cross-sectional structure of the vibration insulator of FIG. 2.
Figure 4:
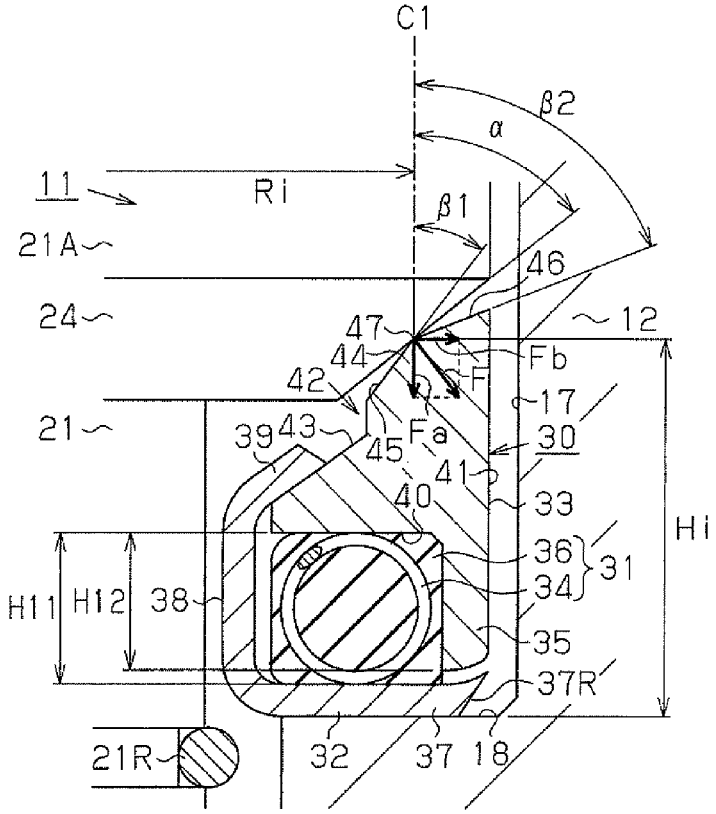
FIG. 4 is an enlarged end view showing the structure of an end face of the vibration insulator of FIG. 3.
Figure 5A:
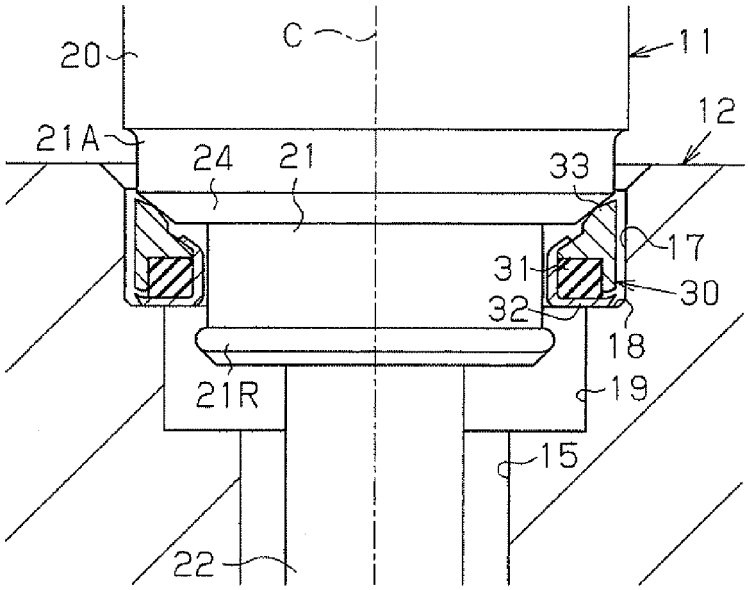
FIGS. 5(*a*) and 5(*b*) are diagrams illustrating a compensating function that responds to deviation of the vibration insulator of FIG. 1 from the centered position, where FIG. 5(*a*) shows a centered state, and FIG. 5(*b*) shows an off-center state.
Figure 5B:
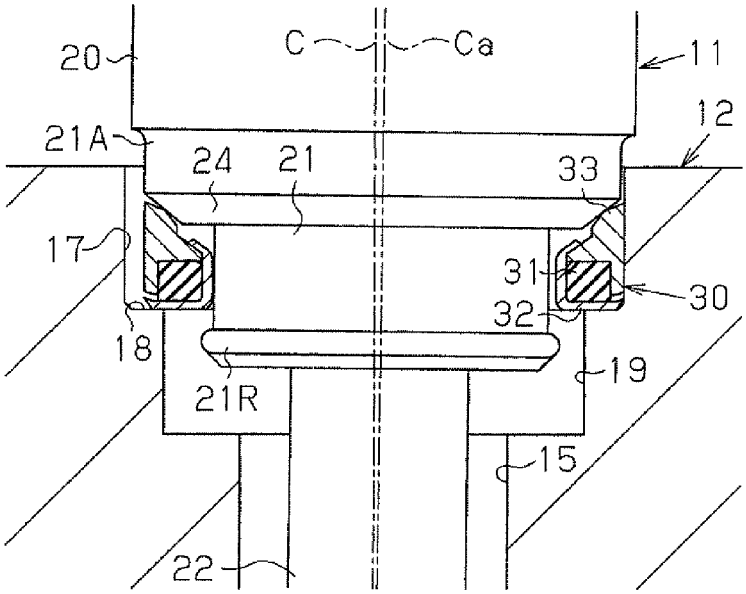

FIG. 1 is a diagram schematically showing a schematic structure of a fuel injection system to which a vibration insulator of this embodiment is applied. FIG. 2 is a diagram showing the structure of the vibration insulator in a flat plane. FIG. 3 is a diagram showing the structure of the vibration insulator in a cross-sectional view. FIG. 4 is a diagram showing the structure of an end face of the vibration insulator in an end view. FIGS. 5(*a*) and 5(*b*) are illustrations for illustrating states of compensating movement performed in response to deviation from the center position of the vibration insulator, where FIG. 5(*a*) is a diagram showing a state where the axis C thereof is centered, and FIG. 5(*b*) is a diagram showing a state where the axis C thereof is off-center.

As shown in FIG. 1, a fuel injection system 10 is provided with a fuel injection valve 11. While a part of the fuel injection valve 11 in the distal end (lower in FIG. 1) thereof is supported by being inserted into an insertion hole 15 of the cylinder head 12, another part of the fuel injection valve 11 in the proximal end (upper in FIG. 1) thereof is supported by a fuel injection valve cup 14 included in a delivery pipe 13. The fuel injection valve 11 is thus built between the cylinder head 12 and the delivery pipe 13.

The insertion hole 15 of the cylinder head 12 is formed, as a hole stepped with multiple steps, to extend through the cylinder head 12 from an outer surface 12A thereof to an inner surface 12B thereof, the hole having a hole diameter that narrows sequentially in a direction from the outer surface 12A of the cylinder head 12 (the upper part of FIG. 1) toward the inner surface 12B thereof (the lower part of FIG. 1) facing a combustion chamber of an internal combustion engine of the in-cylinder injection system. That is, the hole diameter at an inlet section 17 of the insertion hole 15, which is an entrance that opens through the outer surface 12A of the cylinder head 12, is the largest, and the hole diameter at a distal end hole section 16 of the insertion hole 15, which opens through the inner surface 12B, is the smallest. As a result, a stepped section based on a difference in the hole diameter is formed on each part of the insertion hole 15 at which the hole diameter changes, whereby, for example, a shoulder section 18 as one of the stepped sections is formed between the inlet section 17 and an intermediate hole section 19 which continues from the inlet section 17. In other words, the shoulder section 18 is formed such that the opening of an edge section of the intermediate hole section 19 in one side thereof facing the outer surface 12A is annularly enlarged. Since the distal end hole section 16 of the insertion hole 15 is communicated with the combustion chamber of the in-cylinder injection system, an injection nozzle 23 of the fuel injection valve 11 is inserted into and thereby mounted on the distal end hole section 16 of the insertion hole 15. As a result, the distal end hole section 16 is configured to introduce, into the combustion chamber, high pressure fuel injected from the injection nozzle 23.

Since the delivery pipe 13 is designed to supply to the fuel injection valve 11 high pressure fuel, the pressure of which has been accumulated to an injection pressure, the delivery pipe 13 includes the fuel injection valve cup 14 that the proximal end section of the fuel injection valve 11 is inserted into and thereby mounted on. When the proximal end section of the fuel injection valve 11 is inserted into the fuel injection valve cup 14, the fuel sealing performance between the proximal end section of the fuel injection valve 11 and the inner circumferential surface 14A of the fuel injection valve cup 14 is ensured by an O-ring 29 arranged therebetween.

The fuel injection valve 11 is designed to inject high pressure fuel, which is supplied from the delivery pipe 13, into the combustion chamber defined by the cylinder head 12 with predetermined timing. A housing of the fuel injection valve 11 has a cylindrical shape, stepped with multiple steps, which sequentially narrows in directions from the center in the axial direction toward the distal end (the insertion hole 15) and toward the proximal end (the fuel injection valve cup 14).

That is, the housing of the fuel injection valve 11 includes a large diameter section 20 at the center thereof, and includes in order from the large diameter section 20 toward the proximal end: a proximal relay section 26 having a smaller diameter than the large diameter section 20; a proximal insertion section 27 having a smaller diameter than the proximal relay section 26; and a proximal sealing section 28 having a smaller diameter than the proximal insertion section 27. The proximal relay section 26 is provided with a connector 26J to which wiring for transmission of a drive signal to, for example, an electromagnetic valve built inside the fuel injection valve 11 for the purpose of controlling fuel injection. The proximal sealing section 28 is inserted into and thereby supports the O-ring 29.

The O-ring 29 is formed of an elastic member made of rubber or the like that is fuel-resistant, substantially in a circular ring-like shape and has pressure resistance against the pressure of high pressure fuel. The inner circumference of the O-ring 29 is configured to contact tightly to the outer circumferential surface of the proximal sealing section 28, and therefore delivers, through tight contact between the inner circumference of the O-ring 29 and the outer circumferential surface of the proximal sealing section 28, sealing performance that prevents fuel leakage of high pressure fuel between the fuel injection valve 11 and the O-ring 29. Furthermore, the outer circumference of the O-ring 29 is formed into a size that allows the O-ring 29 to tightly contact the inner circumferential surface 14A of the fuel injection valve cup 14 of the delivery pipe 13. As a result, when the proximal end of the fuel injection valve 11 is inserted into the fuel injection valve cup 14 of the delivery pipe 13, the outer circumference of the O-ring 29 of the fuel injection valve 11 tightly contacts the inner circumferential surface 14A of the fuel injection valve cup 14, and thereby displays a sealing performance against the high pressure fuel. When the O-ring 29 displays the sealing performance toward both of the outer circumferential surface of the proximal sealing section 28 and the inner circumferential surface 14A of the fuel injection valve cup 14, the fuel sealing performance against the high pressure fuel is ensured between the fuel injection valve 11 and the fuel injection valve cup 14.

Furthermore, the housing of the fuel injection valve 11 includes in order from the large diameter section 20 toward the distal end: a medium diameter section 21 having a narrower diameter than the large diameter section 20; and a small diameter section 22 having a narrower diameter than the medium diameter section 21. The injection nozzle 23, which injects fuel, is provided at the distal end of the small diameter section 22. A sealing section 25 used for ensuring a sealing performance thereof with the wall surface of the insertion hole 15 to maintain airtightness of the combustion chamber is provided in a part of the small diameter section 22 located nearer to the proximal end than injection nozzle 23 is located.

Between the large diameter section 20 and the medium diameter section 21, a stepped section based on the difference between the outer diameter of the large diameter section 20 and the outer diameter of the medium diameter section 21 is formed, and this stepped section is provided with a tapered surface 24 having a shape narrowed in a direction toward the distal end. That is, when the fuel injection valve 11 is inserted into the insertion hole 15, the tapered surface 24 of the fuel injection valve 11 faces the shoulder section 18 located at the inlet section 17 of the insertion hole 15 of the cylinder head 12 with a predetermined slope. The angle $\alpha$ (refer to FIG. 4) of the tapered surface 24 with respect to the central axis (axis C) of the fuel injection valve 11 is shown as an angle with respect to an axis parallel C1, which is parallel to the axis C. Specifically, although it is preferable for the angle $\alpha$ of this tapered surface 24 to be 30 to 60 degrees, the angle $\alpha$ is selectable from values larger than 0 degrees and smaller than 90 degrees.

An annular vibration insulator 30 is provided between the tapered surface 24 of the fuel injection valve 11 and the shoulder section 18 of the insertion hole 15. The vibration insulator 30 is designed for absorbing and damping, when a change in the fuel pressure of fuel supplied through the delivery pipe 13 has occurred with the fuel having been injected or stopped by the fuel injection valve 11, vibration that occurs to the fuel injection valve 11 based on the fuel pressure change.

The outer diameter Ra (refer to FIGS. 2 and 3) of the vibration insulator 30 is formed with a size that enables the vibration insulator 30 to be placed on the annular shoulder section 18. Furthermore, the inner diameter Rb (refer to FIGS. 2 and 3) of the vibration insulator 30 is formed with a size that permits the medium diameter section 21 of the fuel injection valve 11 to be inserted through the vibration insulator 30 with play existing between the medium diameter section 21 and the vibration insulator 30. As shown in FIGS. 1 and 4, a ring 21R having an outer diameter that is larger than the inner diameter Rb of the vibration insulator 30 is provided in a part of the medium diameter section 21 in the distal end of the fuel injection valve 11. As shown in FIG. 1, the vibration insulator 30, under the condition where the medium diameter section 21 is inserted therethrough, is prevented by the ring 21R from coming off from the medium diameter section 21 of the fuel injection valve 11.

As shown in FIG. 3, the vibration insulator 30 includes: an annular vibration damping member 31; an annular plate 32 formed with a cross section having a channel-like shape substantially surrounding the lower part (the lower side in FIG. 3) and the inner circumferential section (a part facing the axis C in FIG. 3) of the vibration damping member 31; and an annular tolerance ring 33 provided in the upper part of vibration damping member 31 (the upper part in FIG. 2). That is, the plate 32 has a plate bottom section 37, on which the vibration damping member 31 is stacked, and the tolerance ring 33 is further stacked on the vibration damping member 31.

In order to function as a member that absorbs and damps vibration of the fuel injection valve 11, the vibration damping member 31 includes as shown in FIG. 4: an elastic member 36 made of rubber or the like; and an annular coil spring 34 embedded in the elastic member 36 under the condition where the annular coil spring 34 forms the same annular shape as the elastic members 36. That is, the coil spring 34 is formed in a shape obtained by curving a helical long body into a loop such that the helical long body surrounds the fuel injection valve 11. FIG. 4 shows a portion corresponding to one turn of the helix of the coil spring 34, and the helix of the coil spring 34 is formed by having multiple turns as above continually connected to one another. A height H11, which is the helix diameter (outer diameter of one turn) of the helix of this coil spring 34 is also shown in FIG. 4. The coil spring 34 is produced using, as a material, spring steel as exemplified by stainless steel and piano wire. FIGS. 5(*a*) and 5(*b*) omit illustration of the coil spring 34 in order to reduce the complexity of the drawings.

The elastic member 36 is produced using, as a material, rubber or elastomer such as TPE, the rubber having been obtained by using fluorine rubber, nitrile rubber, hydrogenation nitrile rubber, fluorosilicone rubber, or acrylic rubber as a main ingredient and blending into the main ingredient a filler, such as carbon black, silica, clay, or calcium carbonate celite, and an antioxidant, a processing aid, and a vulcanizing agent that are suitable for each kind of rubber.

Thus, characteristics suitable for absorption and damping of vibration that occurs to the fuel injection valve 11 are imparted to the vibration damping member 31 based on vibration absorbing and vibration damping characteristics shown by the elastic member 36 and vibration absorbing and vibration damping characteristics shown by the coil spring 34. Although the elastic member 36 and the coil spring 34 show appropriate vibration absorbing and vibration damping characteristics as long as a load within a predetermined range that permits the maintenance of the elasticity thereof is applied thereto, application of a load exceeding the predetermined range results in plastic deformation thereof and the loss of the elasticity, and thereby prevents the vibration absorbing and vibration damping characteristics from appropriately working. That is, when the elastic member 36 and the coil spring 34 experience deformation to forms vertically crushed by a pressing force from the fuel injection valve 11, the elastic member 36 and the coil spring 34 deform freely as long as an amount of deformation thereof is a predetermined amount of deformation or smaller. However, the elastic member 36 and the coil spring 34 experience plastic deformation when having deformed to a level that exceeds the predetermined amount of deformation. In this embodiment, for example, as long as the height of the vibration damping member 31 after the deformation is within a range from the height H11 thereof in a case when a pressing force is not applied thereto to a predetermined height H12 in a case when a predetermined high pressing force is received thereby, appropriate elastic deformation of the vibration damping member 31 is maintained. In other words, a difference between the height H11 and the height H12 is the predetermined amount of deformation, which indicates the border of the elastic deformation and the plastic deformation of the vibration damping member 31. On the other hand, when a pressing force exceeding the predetermined pressing force causes the vibration damping member 31 to deform such that the height of the vibration damping member 31 is made lower than the height H12, the vibration damping member 31 plastically deforms without appropriate elastic deformation thereof being maintained.

The plate 32 is formed of a metal such as stainless steel, for example, SUS 430, which is a stainless steel material to which a drawing process is easily applicable. As shown in FIG. 4, the plate 32 is formed with a cross section having a channel-like shape, and includes: a plate bottom section 37; a plate inner wall section 38 extending upward from the inner circumference of the plate bottom section 37 and along the vibration damping member 31; a plate cover section 39 folded toward the outer circumference from the upper end of the plate inner wall section 38 and covering a part of an inner circumferential section of the tolerance ring 33.

The vibration damping member 31 is pressed against the upper surface of the plate bottom section 37, and the lower surface of the plate bottom section 37 is caused to abut the shoulder section 18 of the insertion hole 15. As a result, not only suitable sideward sliding ability of the plate 32 with respect to the shoulder section 18 of the insertion hole 15 is maintained, but also the force received by the plate 32 from the vibration damping member 31 is distributed evenly across the annular shoulder section 18. Since the shoulder section 18 is a part of the cylinder head 12 formed of aluminum or the like, the hardness of the shoulder section 18 is lower than that of the coil spring 34. Therefore, it is expected that, when the coil spring 34 comes in direct contact with the shoulder section 18, an inconvenience of having a part of the shoulder section 18, on which a force is concentrated, shaved or deformed may occur. However, in this embodiment, a force received by the plate 32 from the coil spring 34 passes through the annular plate bottom section 37 which corresponds to the annular shoulder section 18, and is transmitted to the shoulder section 18 while being circumferentially dispersed. Therefore, the plate 32 prevents occurrence of the inconvenience that might occur when the coil spring 34 comes in direct contact with the shoulder section 18.

As shown in FIG. 4, a burr section 37R obtained by being pressed is formed at the end section of the plate bottom section 37 in the outer circumference thereof. That is, the burr section 37R is cut diagonally upward from the bottom face of the plate bottom section 37 toward the outer circumference. The vibration insulator 30 is configured to be movable to the outer circumferential surface of the inlet section 17 as shown in FIG. 5(*b*) by sliding on the shoulder section 18 from a position, as shown in FIG. 5(*a*), that is located apart from the outer circumferential surface of the inlet section 17 and in the vicinity of the center of the step of shoulder section 18. In this case, the provision of the burr section 37R makes it possible to prevent the plate bottom section 37 of the vibration insulator 30 from being caught by or overriding a portion that remains unshaved as a bulge at the outer circumferential end of the shoulder section 18. That is, the burr section 37R is formed in a shape that does not come in contact with any portion that remains unshaved as a bulge at the outer circumferential end of the shoulder section 18. A bulge at the outer circumferential end of the shoulder section 18 that the burr section 37R is prevented from coming in contact with any portions may be formed intentionally.

The burr section 37R as described above also prevents the outer circumferential end of the plate bottom section 37 from interfering with any bulge portion at the outer circumferential end of the shoulder section 18, even when the vibration insulator 30 has moved until the vibration insulator 30 abuts the outer circumference of the shoulder section 18. In other words, the burr section 37R prevents decrease in movability of the plate 32, which might be caused, for example, when the plate bottom section 37 is caught by a bulge portion at the outer circumferential end of the shoulder section 18. Besides, the burr section 37R prevents, for example, an incidence where a position (a position that is the height Hi upward apart from the shoulder section 18 in FIG. 4) at which the tolerance ring 33 abuts the tapered surface 24 of the fuel injection valve 11 considerably changes with the plate bottom section 37, which has overridden a bulge portion and become inclined.

As shown in FIG. 4, the plate inner wall section 38 is formed to rise along the vibration damping member 31 from the inner circumferential end of the plate bottom section 37, thereby being extended upward along the medium diameter section 21 of the fuel injection valve 11.

The plate cover section 39 extends such that the distal end section of the plate inner wall section 38 covers a part of an inner circumferential sloping surface 42 of the tolerance ring 33 stacked on the vibration damping member 31. Further, the plate cover section 39 is abutted by the inner circumferential sloping surface 42 of the tolerance ring 33, and imparts to the inner circumferential sloping surface 42 a force acting toward the outer circumference and downward. As a result, the plate cover section 39 functions not only to reinforce connection between the tolerance ring 33 and the vibration damping member 31, but also to prevent the relative position between tolerance ring 33 and vibration damping member 31 from changing.

The tolerance ring 33 supports the fuel injection valve 11 with respect to the cylinder head 12 by abutting the tapered surface 24 of the fuel injection valve 11. The tolerance ring 33 is formed of metal such as stainless steel, for example, SUS 304, which is a hard stainless steel material. Although metal having the same hardness as the tapered surface 24 of the fuel injection valve 11 is adopted as metal used as a material for the tolerance ring 33, metal having the same hardness as a member, the coil spring 34 for example, having another level of hardness may be adopted.

As shown in FIG. 4, in the cross section of the tolerance ring 33, a portion over the vibration damping member 31 (a part facing the proximal end of the fuel injection valve 11) is shaped in a right-angled triangle. In other words, the tolerance ring 33 includes: a ring bottom surface 40 connected to the vibration damping member 31; a ring outer circumferential surface 41; and the inner circumferential sloping surface 42 extending from the upper part of the ring outer circumferential surface 41 to the inner circumferential end of the ring bottom surface 40. That is, as shown in FIG. 3, the inner circumferential sloping surface 42 in the cross section of the tolerance ring 33 forms a shape that tapers toward the center (the axis C) of the tolerance ring 33.

The ring bottom surface 40 is abutted by the upper surface of the vibration damping member 31, as shown in FIG. 4. The ring bottom surface 40 functions to transmit a pressing force to the upper surface of vibration damping member 31 as circumferentially dispersing through the entirety of the annular ring bottom surface 40, the pressing force having been received by the tolerance ring 33 from the fuel injection valve 11, whereby the pressing force is evenly applied to the vibration damping member 31. As a result, inconveniences are prevented from occurring which include an incident where a locally concentrated force causes the vibration damping member 31 to plastically deform.

The diameter of the ring outer circumferential surface 41 is formed to have a diameter substantially equal to the outer diameter Ra of the plate bottom section 37 of the plate 32. In other words, the diameter of the ring outer circumferential surface 41 is made substantially equal to the outer diameter Ra of the vibration insulator 30, and therefore is set not to narrow a range, in the inlet section 17 of the insertion hole 15, across which the vibration insulator 30 moves in the radial direction thereof.

As shown in FIG. 4, the inner circumferential sloping surface 42 is configured to have three slopes. In other words, the inner circumferential sloping surface 42 has: a joint section 43 provided as a joint sloping surface extending diagonally toward the outer circumference from the ring bottom surface 40 of the tolerance ring 33; an inner tapered surface 45, which is one step higher than the joint section 43 and extends diagonally further toward the outer circumference; and an outer tapered surface 46, which extends, from the inner tapered surface 45, diagonally further toward the outer circumference at a moderate angle. The inner tapered surface 45 and the outer tapered surface 46 constitute an abutting section 44, which faces the tapered surface 24 of the fuel injection valve 11. In other words, the joint section 43 is located in the inner circumference with respect to the abutting section 44, and most of the joint section 43 does not face the tapered surface 24 of the fuel injection valve 11.

Specifically, the inner circumferential edge of the joint section 43 continues into the inner circumferential edge of the ring bottom surface 40 via the inner circumferential surface of the tolerance ring 33. The plate cover section 39 of the plate 32 is bent toward the outer circumference to abut the joint section 43. In other words, a force that acts toward the outer circumference and downward (toward the vibration damping member 31) is imparted by the plate cover section 39 to the joint section 43. Therefore, pressure contact of the tolerance ring 33 to the vibration damping member 31 is reinforced, and the relative positional relationship thereof with the vibration damping member 31 is maintained unchanged.

A ridgeline 47 serving as a boundary between the inner tapered surface 45 and the outer tapered surface 46 is shown in FIG. 4 as a corner (an apex) of a protrusion sticking out toward the inner circumference from the abutting section 44. That is, while the ridgeline 47 is a part at which the outer circumferential edge of the inner tapered surface 45 abuts the inner circumferential edge of the outer tapered surface 46, the inner tapered surface 45 and the outer tapered surface 46 constitute surfaces in a part of the tolerance ring 33 with two surfaces, the part facing the tapered surface 24 of the fuel injection valve 11. In FIG. 4, the angle $\beta 1$ of the inner tapered surface 45, the angle $\beta 2$ of the outer tapered surface 46 and the angle $\alpha$ of the tapered surface 24 of the fuel injection valve 11 are indicated as the respective angles of inclination to the axis parallel C1 of the tolerance ring 33. Furthermore, while the angle $\beta 1$ of the inner tapered surface 45 is set smaller than the angle $\alpha$ of the tapered surface 24 of the fuel injection valve 11, the angle β1 of the outer tapered surface 46 is set larger than the angle α of the tapered surface 24 of the fuel injection valve 11 (β1<α<β2). That is, the angle (tapering angle) β1 of the inner tapered surface 45 and the angle (tapering angle) β2 of the outer tapered surface 46 are set to angles different from the angle (tapering angle) α of the tapered surface 24 of the fuel injection valve 11, respectively. As a result, the relationship of the angle β1 of inner tapered surface 45 and the angle β2 of the outer tapered surface 46 with the angle α of the tapered surface 24 of the fuel injection valve 11 is such that the angle α is set to a size between the angle β1 and the angle β2. The ridgeline 47, shown in FIG. 2, which is located between the inner tapered surface 45 and the outer tapered surface 46 and has a circular shape, appears in FIG. 4 as an apex that makes point contact with the tapered surface 24 of the fuel injection valve 11. In other words, the ridgeline 47 makes line contact with the tapered surface 24 of the fuel injection valve 11. Accordingly, the inner circumferential surface of the tolerance ring 33, the ring bottom surface 40 and the ring outer circumferential surface 41 constitute surfaces in a part of the tolerance ring 33, the part facing away from the tapered surface 24 of the fuel injection valve 11.

FIG. 5(*b*) shows the axis Ca of the fuel injection valve 11 when the axis Ca is off-center with respect to the cylinder head 12. Even when the fuel injection valve 11 inclines as shown in FIG. 5(*b*) as compared to FIG. 5(*a*), a change in the height Hi from the shoulder section 18 of insertion hole 15 to the ridgeline 47 is unlikely to occur because the vibration insulator 30 laterally (the radial direction) slides on the shoulder section 18. As a result, a supported height of the fuel injection valve 11 with respect to the shoulder section 18 is maintained at the predefined height Hi. Furthermore, the vibration insulator 30 is capable of moving laterally in a manner following the deviation of the axis C of the fuel injection valve 11 from the centered position, whereby, even with the axis C of the fuel injection valve 11 being off-center, as in the case of the axis Ca, the length of a line segment extended from the ridgeline 47 to the axis Ca in the radial direction is kept equal to the length Ri of a line segment extended from the ridgeline 47 to the axis C in the radial direction when the axis C is centered as in the case of FIG. 5(*a*). In other words, the distance from the centerline of the fuel injection valve 11 to the ridgeline 47 is maintained at a predetermined distance, that is, the length Ri.

Furthermore, when the axis C is deviated from the centered position under the influence of thermal expansion or the like, the vibration insulator 30 receives a laterally acting force from the fuel injection valve 11 due to a change in fuel pressure. The vibration insulator 30 is configured to absorb and damp vibration of the fuel injection valve 11 to a certain degree, but not to have the shape thereof flexed to a large degree, at the moment when the vibration insulator 30 receives the laterally acting force. In other words, the laterally acting force is hardly absorbed by the vibration insulator 30 and is efficiently used as a force that laterally moves the vibration insulator 30 on the shoulder section 18. That is, when the axis C is deviated from the centered position, the vibration insulator 30 quickly reacts to a laterally acting force received thereby from the fuel injection valve 11, and makes a movement in the inlet section 17 with a high level of responsiveness.

As shown in FIG. 4, when a force F is applied to the tolerance ring 33 from the tapered surface 24 of the fuel injection valve 11, a force (a component of force of the load in the axial direction, that is, a load in the axial direction) Fa acting in a direction along the axis parallel C1, and a force (a component of force of the load in the radial direction, that is, a load in the radial direction) Fb acting in a direction orthogonal to the axis parallel C1 are applied to the ridgeline 47 of the tolerance ring 33 in accordance with the angle α of the tapered surface 24. The force Fa acting in the direction along the axis parallel C1 is transmitted to the shoulder section 18 via the vibration damping member 31 and the plate 32. On the other hand, the force Fb acting in the direction orthogonal to the axis parallel C1 acts as a force that presses the upper part of the tolerance ring 33 toward the outer circumference thereof. At this moment, for such reasons as no abutment of the ring outer circumferential surface 41 to a side surface or the like of the inlet section 17, the tolerance ring 33 might be unable to withstand this force Fb and be warped in a manner that a portion corresponding to the ridgeline 47 is opened outward together with the ring outer circumferential surface 41. When the position of the ridgeline 47 moves outward by warping of the tolerance ring 33, a part that is in the tapered surface 24 of the fuel injection valve 11 and abutting the ridgeline 47 moves toward the proximal section of the fuel injection valve 11, that is, toward the upper part of the tapered surface 24. In other words, the fuel injection valve 11 enters more deeply into the insertion hole 15 of the cylinder head 12. In other words, the fuel injection valve 11 moves further toward the distal end (downward) with respect to the cylinder head 12, and the supported height of the fuel injection valve 11 by the cylinder head 12 is lowered without being maintained at the height Hi.

For this reason, in this embodiment, the tolerance ring 33 has a sleeve section 35, which extends from the ring bottom surface 40 toward the plate 32 and has a circular ring-like shape. The sleeve section 35 extends in the axial direction from a part of the ring bottom surface 40 along the outer circumference of the vibration damping member 31, the part being toward the ring outer circumferential surface 41. The sleeve section 35 is formed integrally with the tolerance ring 33, and therefore, is formed of metal such as stainless steel, for example, SUS 304, which is a hard stainless steel material, as in the case of the tolerance ring 33.

The size of the sleeve section 35 that extends from the ring bottom surface 40 toward the plate 32, that is, the size thereof in the axial direction is formed substantially into the height H12. This height H12 is lower than the height H11 of the vibration damping member 31 when a high pressing force is not received thereby (H12<H11). For this reason, a gap (gap≤H11−H12) exists between the distal end section of the sleeve section 35 and the plate bottom section 37 when the tolerance ring 33 does not receive a high pressing force from the fuel injection valve 11. Since the burr section 37R of the plate 32 has the outer circumference thereof warped upward, a portion of the distal end of the sleeve section 35 that faces the burr section 37R is curved into a shape that follows the shape of the burr section 37R, so that a gap between this portion and the burr section 37R may be maintained at the length of H11−H12. For this reason, the size of the outer circumference of the sleeve section 35 in the axial direction is formed shorter than the height H12.

As a result, when the height of the vibration damping member 31 becomes the height H12 in the case that the tolerance ring 33 presses and deforms the vibration damping member 31 through the ring bottom surface 40 upon receiving a high pressing force from the fuel injection valve 11, the sleeve section 35 of the tolerance ring 33 abut the plate 32. Therefore, the distance between the ring bottom surface 40 and the plate 32 is maintained at least at the height H12. That is, the vibration damping member 31 located between the ring bottom surface 40 and the plate 32 is not deformed into a height that is lower than the height H12. The height H12 is a height that guarantees that the amount of the deformation does not exceed a predetermined amount of deformation that permits the maintenance of elastic deformation of the vibration damping member 31. Therefore, the sleeve section 35 eliminates a possibility of having the vibration damping member 31 deformed into a height lower than the height H12 and thereby resulting in a fall in the vibration damping characteristic thereof or in plastic deformation thereof. As a result, the sleeve section 35 guarantees that the vibration damping member 31 is maintained at a height between the height H12 and the height H11 and suitably shows the vibration damping performance thereof.

When the vibration damping member 31 is at the height H12, the sleeve section 35 transmits a pressing force to the shoulder section 18 of the insertion hole 15 through the upper surface of the plate bottom section 37. Therefore, while the suitable lateral sliding ability of the plate 32 on the shoulder section 18 of the insertion hole 15 is maintained, the pressing force from the sleeve section 35 is evenly distributed across the shoulder section 18 through the plate 32. This prevents occurrence of inconveniences such as an incident where, when the sleeve section 35 having a higher level of hardness than shoulder section 18 comes in direct contact with the shoulder section 18 formed of aluminum as a part of the cylinder head 12, the shoulder section 18 is shaved or deformed.

Furthermore, the inner circumferential surface of the sleeve section 35 contacts the vibration damping member 31 but does not contact the coil spring 34. That is, the vibration damping member 31 has the elastic member 36 toward the outer circumference of the coil spring 34, and a part of the elastic member 36 that faces the outer circumference of the coil spring 34 abuts the sleeve section 35. This eliminates a possibility that the vibration absorbing and vibration damping characteristics of the coil spring 34 are changed as a result of contact of the coil spring 34 with the sleeve section 35. The vibration damping member 31 is capable of suitably displaying the vibration absorbing and vibration damping characteristics in a state where the influence from the sleeve section 35 is small.

Next, movement performed by the tolerance ring 33 in response to the pressing force is described.

When the force F from the tapered surface 24 of the fuel injection valve 11 is applied to the tolerance ring 33, the force Fa acting in the direction along the axis parallel C1 and the force Fb acting in the direction orthogonal to the axis parallel C1 are applied to the ridgeline 47 of the tolerance ring 33 in accordance with the angle $\alpha$ of the tapered surface 24. As a result, the force Fa acting in the direction along the axis parallel C1 presses the vibration damping member 31 and, at the same time, is transmitted to the shoulder section 18 through the vibration damping member 31 and the plate 32. At this time, the vibration damping member 31 tends to expand laterally, that is, in the radial direction along with decrease of the height thereof when being pressed by the force Fa. In other words, the inner circumferential surface of the vibration damping member 31 tends to expand toward the inner circumference, and the outer circumferential surface tends to expand toward the outer circumference, whereby forces acting toward the inner circumference and toward the outer circumference occur from the vibration damping member 31. On this basis, a pressing force acting from the vibration damping member 31 toward the outer circumference is transmitted to the sleeve section 35 abutting the outer circumferential surface of the vibration damping member 31. In other words, the sleeve section 35 forming the lower part of the tolerance ring 33 receives an outward acting force.

On the other hand, the force Fb that acts in the direction orthogonal to the axis parallel C1 acts to enlarge the opening of the upper part of the tolerance ring 33 outward, as described above.

That is, in the force F received by the tolerance ring 33 from the tapered surface 24 of the fuel injection valve 11, the force Fb acting in the direction orthogonal to the axis parallel C1 acts to enlarge the upper part of the tolerance ring 33 toward the outer circumference, whereas the force Fa acting in the direction along the axis parallel C1 presses the lower part of the tolerance ring 33 toward the outer circumference through the vibration damping member 31 in this embodiment. As a result, at least a part of the force Fb, which tends to enlarge the upper part of the tolerance ring 33, is cancelled by a force with which the vibration damping member 31 presses the sleeve section 35 laterally. As a result, enlargement of the opening of the upper part of tolerance ring 33 is suppressed. In other words, in such a manner as to oppose a moment attributable to the force Fb, which tends to enlarge the upper part of the tolerance ring 33 in a direction that enlarges the opening thereof, a moment that acts in a reverse direction thereto attributable to a force acting from the vibration damping member 31 on the sleeve section 35, which is the lower part of the tolerance ring 33, comes to act on the tolerance ring 33. This prevents the force Fb from unilaterally warping the tolerance ring 33.

Additionally, since the stiffness (moment of inertia) of the tolerance ring 33 as a whole is improved by integration of the sleeve section 35 with the tolerance ring 33, the opening of the upper part of the tolerance ring 33 is prevented from enlarging. Furthermore, in the lower part of the tolerance ring 33, which is compressed and deformed (shrunken) along with enlargement of the opening of the upper part of the tolerance ring 33, the sleeve section 35 integrally formed comes to have a structure opposing the compression and deformation thereof, and thereby performs the function of suppressing enlargement of the opening of the upper part of the tolerance ring 33.

As described above, the vibration insulator of this embodiment brings about advantages as listed below.

(1) The stiffness of the tolerance ring 33 itself is increased by the sleeve section, which is formed integrally with the tolerance ring 33 and extends from the tolerance ring 33. Therefore, improvement in durability of the tolerance ring 33 against the force Fb that is received by the tolerance ring 33 from the tapered surface 24 of the fuel injection valve 11 and acts to enlarge the opening of the tolerance ring 33 is enabled. This serves to prevent occurrence of warping of the tolerance ring 33, and also to maintain the position of the tapered surface 24 of the fuel injection valve 11 abutting the tolerance ring 33. That is, the fuel injection position of the fuel injection valve 11 is suitably maintained, and the combustion state is also appropriately maintained.

(2) When the elastic member 36 deforms by receiving a strong pressing force from the fuel injection valve 11, the sleeve section 35 comes in contact with the shoulder section 18 through the plate 32. On this basis, excessive deformation of the elastic member 36, which might deform plastically when having deformed to a large extent, is restricted. That is, it is made possible to use the elastic member 36 while keeping the elastic member 36 from deforming beyond the extent (the range of H11 to H12 in terms of height of the elastic member 36. The amount of deformation of the elastic member 36 is 0 to (H11−H12) using the heights) that allows elastic deformation. This serves to suitably maintain the elasticity of the elastic member 36, and maintain the vibration absorption and damping function using the elasticity.

(3) Excessive deformation of the elastic member 36, the elasticity of which is adjusted by the coil spring 34, is restricted by the sleeve section 35. In other words, the elastic member 36 is used within a range (of H11 to H12 in terms of height) that enables elastic deformation thereof. This serves to suitably maintain the elasticity of the elastic member 36, and maintain the vibration absorption and damping function using the elasticity thereof.

(4) While the elastic member 36, which tends to deform in a manner radially expanding when being pressed, presses the sleeve section 35 toward the outer circumference, the abutting section 44 (the ridgeline 47) of the tolerance ring 33 receives from the fuel injection valve 11 the force Fb that acts in the direction that enlarges the opening of the abutting section 44. That is, the tolerance ring 33 receives outward-acting forces at the abutting section 44 (the ridgeline 47) and the sleeve section 35, respectively, whereby occurrence of warping is prevented as compared to a case where an outward-acting force is received only at the abutting section 44 (the ridgeline 47). Consequently, it is made possible to maintain the position, in the tapered surface 24 of the fuel injection valve 11, at which the abutting section 44 of the tolerance ring 33 is abutted thereby. This serves to suitably maintain the fuel injection position of the fuel injection valve 11 with respect to the combustion chamber, and thereby also serves to maintain the most suitable combustion state.

(5) The relative position of the tolerance ring 33, which cannot be easily joined strongly to the elastic member 36, with respect to the elastic member 36 is defined by the plate 32 from the inner circumferential surface of the tolerance ring 33. Therefore, appropriate stacking of the tolerance ring 33 on the elastic member 36 is facilitated, whereby improvement of the feasibility of the vibration insulator 30 as described herein is enabled.

(6) The outer circumferential edge of the plate 32 is molded into a shape where a burr, cut upward toward the elastic member 36, appears. Therefore, even in a case where a bulge portion is formed in a region from the shoulder section 18 of the cylinder head 12 toward the inlet section 17, the plate 32 is prevented from overriding or being caught by the bulge portion. This serves to form the size of the shoulder section 18, formed in the insertion hole 15 of the cylinder head 12, into the requisite minimum size that enables deviation of the axis C of the fuel injection valve 11 from the centered position to be compensated by movement of the vibration insulator 30.

(7) A pressing force that acts on the fuel injection valve 11 is circumferentially evenly distributed when the annular tapered surface 24 abuts the annular abutting section 44 (the ridgeline 47). Therefore, compensating movement that responds to deviation of the axis C of the fuel injection valve 11 from the centered position is suitably performed.

Second Embodiment

Figure 6:
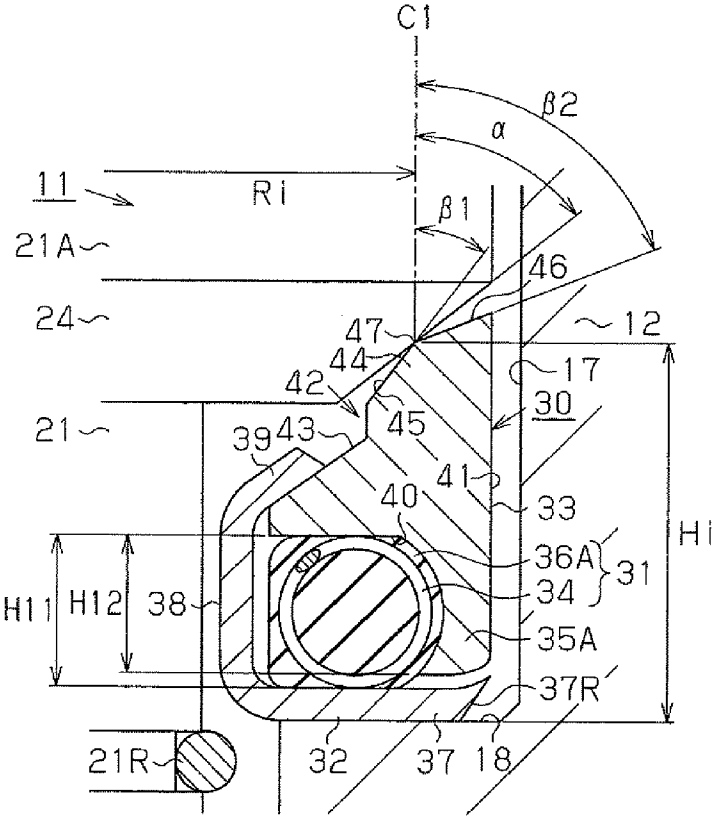
FIG. 6 is an end view showing the structure of an end face of the vibration insulator according to a second embodiment of the present invention.

FIG. 6 is an end view showing the structure of a vibration insulator 30 according to a second embodiment of the present invention. Since this embodiment differs from the first embodiment in structure of the vibration insulator 30 but the other structures are the same, differences from the first embodiment are mainly described, and description of members similar to those of the first embodiment is omitted by assigning the same reference signs thereto, for illustrative purposes.

As shown in FIG. 6, the vibration insulator 30 is formed by sequentially stacking a vibration damping member 31 and the tolerance ring 33 on a plate bottom section 37 of a plate 32.

The vibration damping member 31 includes: an elastic member 36A formed of rubber or the like, which is similar to the elastic member 36 described in the first embodiment; and an annular coil spring 34 embedded in the elastic member 36A. In this embodiment, the outer circumferential surface of the elastic member 36A covers the circumference of one turn of the helix of the coil spring 34 with a predetermined thickness, thereby being formed into an arcuate shape homothetic to an arc of one turn of the helix thereof.

A sleeve section 35A of the tolerance ring 33 also has a circular ring-like shape extending along the outer circumferential surface of the vibration damping member 31 toward the plate 32 from a part of a ring bottom surface 40 that faces a ring outer circumferential surface 41. In a cross-sectional view, the inner circumferential surface of the sleeve section 35A is formed in an arcuate shape bowed at the center in the height direction thereof. The arcuate shape of this sleeve section 35A is homothetic to the helix of the coil spring 34, and is formed into a state where the arcuate outer circumferential surface of the elastic member 36A is abutted thereby. Therefore, the arcuate outer circumferential surface of the elastic member 36A comes to abut the arc-shaped inner circumferential surface of the sleeve section 35A. That is, the outer circumferential surface of the coil spring 34 is opposed to the arc-shaped inner circumferential surface of the sleeve section 35A through the predetermined-thickness portion of the elastic member 36A. This serves to transmit a force from the outer circumferential surface of the coil spring 34 evenly to the arcuate inner circumferential surface of the sleeve section 35A through the predetermined-thickness portion of the elastic member 36A.

For example, suppose that, when a force from a tapered surface 24 of a fuel injection valve 11 is applied to the tolerance ring 33, a force Fa acting in the direction along a axis parallel C1 and a force Fb acting in the direction orthogonal to the axis parallel C1 is applied to a ridgeline 47 of the tolerance ring 33 in accordance with an angle $\alpha$ of the tapered surface 24. Then, when the coil spring 34 is vertically compressed by the force Fa acting in the direction along the axis parallel C1 and deforms in a laterally expanding manner, a force that expands from the coil spring 34 toward the outer circumference is transmitted evenly to the arcuate inner circumferential surface of the sleeve section 35A, which has a similar shape to the outer circumferential surface of the coil spring 34, through the elastic member 36A, which has an uniform thickness in the direction all along the circumference of the arc. As a result, a force that is generated by the deformation of the coil spring 34 and acts toward the outer circumference is more smoothly transmitted uniformly to the inner circumferential surface of sleeve section 35A all along the vertically extending arc. In other words, a force that cancels a force that enlarges the opening of the upper part of the tolerance ring 33 occurs in a larger magnitude to the sleeve section 35A. Additionally, the length of an arc, appearing in FIG. 6, of a contact surface of the outer circumferential surface of the vibration damping member 31 through which this outer circumferential surface comes in contact with the inner circumferential surface of the sleeve section 35A is made longer. On this basis, the force from the vibration damping member 31 comes to be efficiently transmitted to the sleeve section 35A. Further, the inner circumferential surface of the sleeve section 35A has a structure surrounding the outer circumferential surface of the vibration damping member 31, whereby it is also made possible for the inner circumferential surface of the sleeve section 35A to receive a force from the outer circumferential surface of the vibration damping member 31 without fail.

Furthermore, since the stiffness of the tolerance ring 33 is improved by integration of the sleeve section 35A with the tolerance ring 33, the opening of the upper part of the tolerance ring 33 is prevented from enlarging. Further, in the lower part of the tolerance ring 33, which is shrunk as the opening of the upper part of the tolerance ring 33 enlarges, the sleeve section 35A forms a structure that resists such shrinkage. Also on this basis, enlargement of the opening of the upper part of the tolerance ring 33 is suppressed.

As described above, this embodiment not only brings about advantages that are the same as or similar to the above advantages (1) to (7) of the first embodiment described above, but also brings about advantages as listed below.

(8) A force generated from the outer circumferential surface, having an arcuate shape in a cross section, of the elastic member 36, which deforms toward the outer circumference by being pressed, is transmitted to the inner circumferential surface, having an arcuate shape in a cross section, of the sleeve section 35A without being dispersed. Therefore, when having deformed, the elastic member 36 presses the sleeve section 35A with a stronger force toward the outer circumference. As a result, warping of the tolerance ring 33, which is caused by a force received by the tolerance ring 33 from the tapered surface 24 of the fuel injection valve 11, is suppressed to a greater extent. Therefore, it is made possible to maintain, in the tapered surface 24 of the fuel injection valve 11, a position that abuts the abutting section 44.

Third Embodiment

Figure 7:
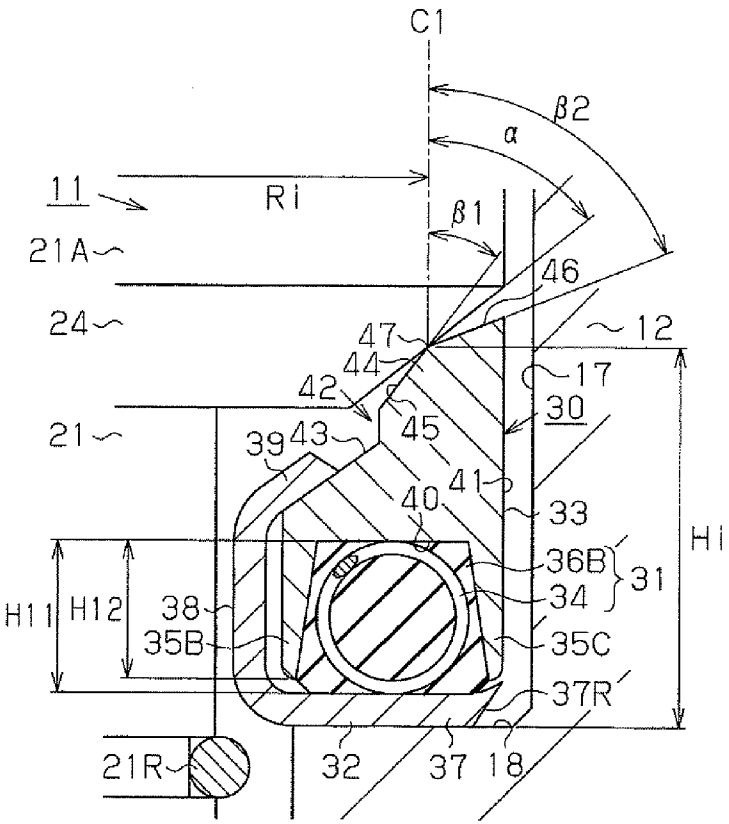
FIG. 7 is an end view showing the structure of an end face of the vibration insulator according to a third embodiment of the present invention.

FIG. 7 is an end view showing the structure of a vibration insulator 30 according to a third embodiment of the present invention. Since this embodiment differs from the first embodiment in structure of the vibration insulator 30 but the other structures are the same, differences from the first embodiment are mainly described, and description of members similar to those of the first embodiment is omitted by assigning the same reference signs thereto, for illustrative purposes.

As shown in FIG. 7, the vibration insulator 30 is formed by sequentially stacking a vibration damping member 31 and a tolerance ring 33 on a plate bottom section 37 of a plate 32.

The vibration damping member 31 includes: an elastic member 362 formed of rubber or the like, which is similar to the elastic member 36 described in the first embodiment; and an annular coil spring 34 embedded in the elastic member 36B.

The tolerance ring 33 includes: an inner sleeve section 35B extending toward the plate 32 from a part of a ring bottom surface 40 in the inner circumference thereof and having a circular ring-like shape; and an outer sleeve section 35C extending toward the plate 32 from another part of the ring bottom surface 40 in the inner circumference thereof and having a circular ring-like shape. The inner circumferential surface of the inner sleeve section 35B is extended out toward the plate 32, along a plate inner wall section 38, in parallel to a axis parallel C1. On the other hand, the outer circumferential surface of the inner sleeve section 35B is inclined relative to the axis parallel C1, so that the cross section of the inner sleeve section 358 is formed in a tapering, wedge shape. In other words, the thickness of the inner sleeve section 35B is formed to be thicker toward the ring bottom surface 40 and thinner toward the plate 32.

Additionally, the outer circumferential surface of the outer sleeve section 35C is extended out toward the plate 32, along a ring outer circumferential surface 41, in parallel to the axis parallel C1. On the other hand, the inner circumferential surface of the outer sleeve section 35C is inclined relative to the axis parallel C1, and the cross section of the outer sleeve section 350 is also formed in a tapering, wedge shape. In other words, the cross section of the outer sleeve section 35C is formed to be thicker toward the ring bottom surface 40 and thinner toward the plate 32. That is, the cross section of a space defined by the inner sleeve section 35B and the outer sleeve section 35C is a trapezoid shape, the size of the above space in the radial direction of the tolerance ring 33 sequentially becomes larger from the ring bottom surface 40 toward the plate 32.

Further, in this embodiment, the vibration damping member 31 is formed into a cross-sectional shape of a trapezoid to be fitted in the space defined as described above and having a trapezoid shape, and is placed in the space. The vibration damping member 31 of this embodiment is also at the height H11.

For example, when the vibration damping member 31 is pressed by the force Fa in the direction along the axis parallel C1 as a result of application of a force from the tapered surface 24 of a fuel injection valve 11 to the tolerance ring 33, deformation of the vibration damping member 31 is suppressed by the ring bottom surface 40, the inner sleeve section 35B and the outer sleeve section 35C, which surround the circumference of the vibration damping member 31. On this basis, a force that tends to deform the vibration damping member 31 acts as a force (a reactive force) that presses back the ring bottom surface 40 upward. Therefore, a part of a downward acting force Fa, which acts on the tolerance ring 33 and acts in the direction along the axis parallel C1, is cancelled.

Furthermore, when being pressed by the force Fa in the direction along the axis parallel C1, the vibration damping member 31 deforms to become lower in height, which prompts the inner circumferential surface thereof to tend to expand toward the inner circumference and prompts the outer circumferential surface to expand toward the outer circumference. However, such expansion is suppressed by the inner sleeve section 35B and the outer sleeve section 35C. Therefore, both of a force that presses the vibration damping member 31 from the inner circumferential surface thereof toward the outer circumference and a force that presses the vibration damping member 31 from the outer circumferential surface thereof toward the inner circumference act on the vibration damping member 31. That is, when the coil spring 34 is pressed downward and going to deform to expand laterally, a force of the coil spring 34 going to expand toward the inner circumference acts on the inner sleeve section 35B, and a part of this force acts as a force that presses the inner sleeve section 35B upward in accordance with the slope of the inner sleeve section 35B. This also serves to cancel a part of the force, which acts on the tolerance ring 33 and acts in the direction along the axis parallel C1. Additionally, a force of the coil spring 34 going to expand to the outer circumference acts on the outer sleeve section 35C, and a part of the thus acting force acts as a force that presses the outer sleeve section 35C upward in accordance with the slope of the outer sleeve section 350. This also serves to cancel a part of the force, which acts on the tolerance ring 33 and acts in the direction along the axis parallel C1.

That is, forces that occur to the vibration damping member 31 when the tolerance ring 33 is going to deform the vibration damping member 31, and act toward the inner circumference and toward the outer circumference are converted by the inner sleeve section 35B and the outer sleeve section 35C, which have sloping surfaces, respectively, into forces that act on the upper part of the tolerance ring 33. Therefore, the height of the vibration damping member 31 is prevented from changing. As a result, the tolerance ring 33 is prevented from entering into the insertion hole 15 of cylinder head 12 more deeply than necessary.

Additionally, since the stiffness of the tolerance ring 33 is improved by integration of the inner sleeve section 35B and the outer sleeve section 35C with the tolerance ring 33, the opening of the upper part of the tolerance ring 33 is prevented from enlarging. Furthermore, in the lower part of the tolerance ring 33, which is shrunk as the opening of the upper part of the tolerance ring 33 enlarges, the inner sleeve section 35B and the outer sleeve section 35C formed integrally with the tolerance ring 33 form a structure that resist the shrinkage of the lower part of tolerance ring 33. Also on this basis, the opening of the upper part of the tolerance ring 33 is prevented from enlarging.

As described above, this embodiment not only brings about advantages that are the same as or similar to the above advantages (1) to (7) of the first embodiment described above, but also brings about advantages as listed below.

(9) The elastic member 36 is sandwiched between the inner sleeve section 35B and the outer sleeve section 35C of the tolerance ring 33. Therefore, a reactive force of the elastic member 36, which occurs in response to a pressing force from the fuel injection valve 11 acts toward the tolerance ring 33 (upward) through the inner sleeve section 355 and the outer sleeve section 35C. As a result, even when the tolerance ring 33 is pressed by the fuel injection valve 11, the vertical position of the tolerance ring 33 with respect to the shoulder section 18 of the cylinder head 12 is maintained. Therefore, the fuel injection position, with respect to the combustion chamber, of the fuel injection valve 11 supported by the tolerance ring 33 is suitably maintained, and the most suitable combustion state is maintained as well.

(10) Forces (reactive forces) that have occurred to the elastic member 36 due to a pressing force from the fuel injection valve 11 and act toward the inner circumference and toward the outer circumference are converted, into reactive forces that resist the pressing force acting from the fuel injection valve 11, in accordance with the sloping angles of the inner sleeve section 35B and the outer sleeve section 35C, which face each other such that the elastic member 36 is sandwiched therebetween. As a result, the vertical position of the tolerance ring 33 with respect to the shoulder section 18 of the cylinder head 12 is maintained. This also serves to suitably maintain, with respect to the combustion chamber, the fuel injection position of the fuel injection valve 11 supported by the tolerance ring 33, and further serves to maintain the most suitable combustion state as well.

Fourth Embodiment

Figure 8:
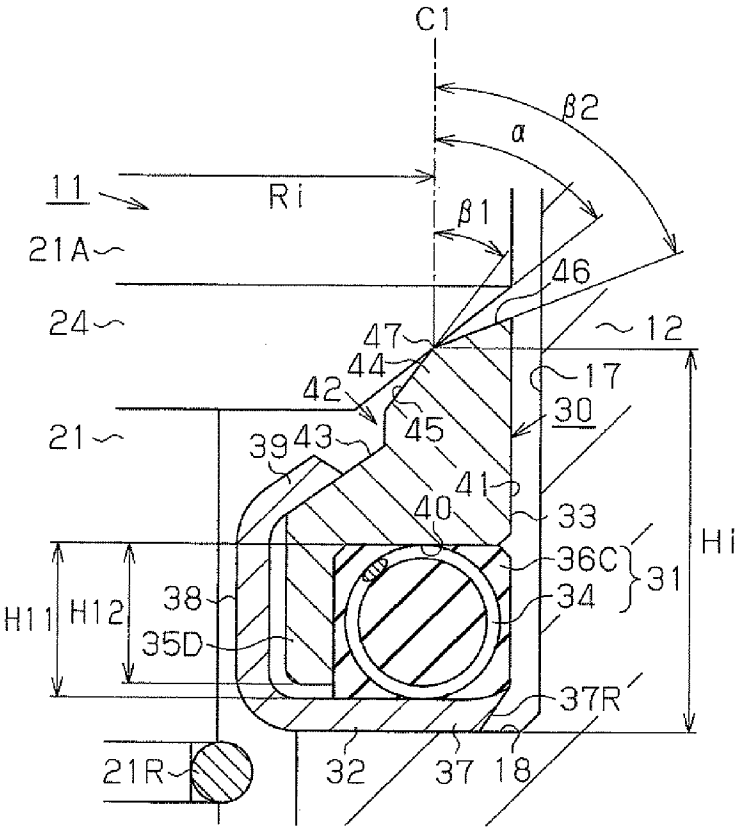
FIG. 8 is an end view showing the structure of an end face of the vibration insulator according to a fourth embodiment of the present invention.

FIG. 8 is an end view showing the structure of a vibration insulator 30 according to a fourth embodiment of the present invention. Since this embodiment differs from the first embodiment in structure of the vibration insulator 30 but the other structures are the same, differences from the first embodiment are mainly described, and description of members similar to those of the first embodiment is omitted by assigning the same reference signs thereto, for illustrative purposes.

As shown in FIG. 8, the vibration insulator 30 is formed by sequentially stacking a vibration damping member 31 and a tolerance ring 33 on a plate bottom section 37 of a plate 32.

The vibration damping member 31 includes: an elastic member 36C formed of rubber or the like, which is similar to the elastic member 36 described in the first embodiment; and an annular coil spring 34 embedded in the elastic member 36C.

A sleeve section 35D of the tolerance ring 33 has a circular ring-like shape extending, along the inner circumferential surface of the vibration damping member 31, toward the plate 32 from an inner circumferential part (a part that is closer to the inner circumference than an inner circumferential sloping surface 42 is) of a ring bottom surface 40. The height of the sleeve section 35D from the ring bottom surface 40 is H12. In other words, the distal end section of the sleeve section 350 is formed so that a gap (gap=H11−H12) may be ensured between the distal end section and a plate bottom section 37 in the direction along a axis parallel C1.

As a result, since the stiffness of the tolerance ring 33 is improved by integration of the sleeve section 35D with the tolerance ring 33, the opening of the upper part of the tolerance ring 33 is prevented from enlarging. Furthermore, in the lower part of the tolerance ring 33, which is shrunk as the opening of the upper part of the tolerance ring 33 enlarges, the sleeve section 350 is formed integrally with the tolerance ring 33, thereby forming a structure that resists such shrinkage. Also on this basis, the opening of the upper part of the tolerance ring 33 is prevented from enlarging.

As described above, this embodiment not only brings about advantages that are the same as or similar to the above advantages (1) to (3) and (5) to (7) of the first embodiment described above, but also brings about advantages as listed below.

(11) Even the sleeve section 35D, which extends from the inner circumferential part of the tolerance ring 33, serves to improve the stiffness of tolerance ring 33. Therefore, even when the tolerance ring 33 receives a force that acts to enlarge the opening of the tolerance ring 33 from the tapered surface 24 of the fuel injection valve 11, improvement in durability of the tolerance ring 33 against this force is enabled.

Fifth Embodiment

Figure 9:
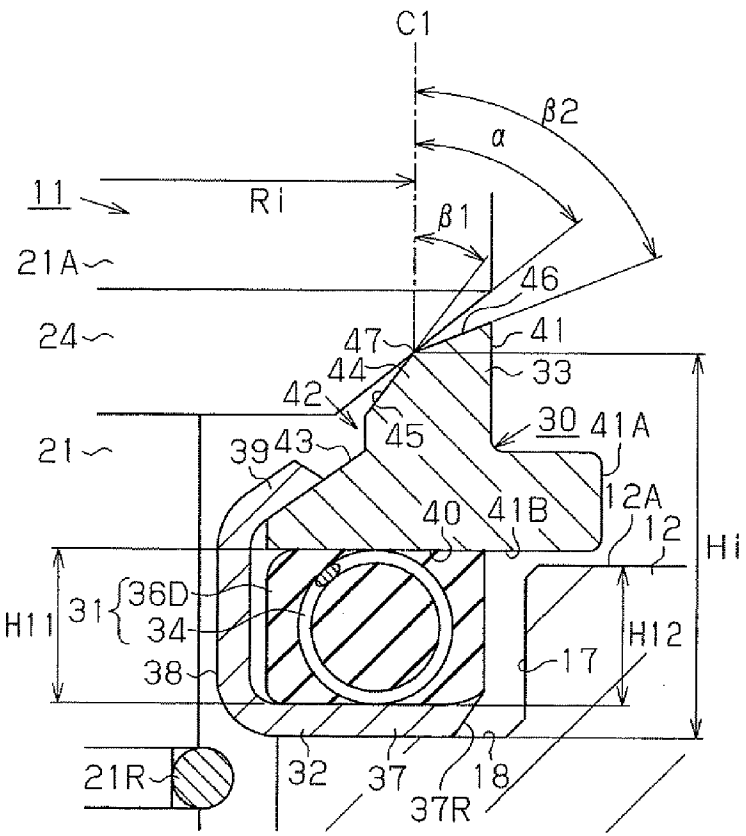
FIG. 9 is an end view showing the structure of an end face of the vibration insulator according to a fifth embodiment of the present invention.

FIG. 9 is an end view showing the structure of a vibration insulator 30 according to a fifth embodiment of the present invention. Since this embodiment differs from the first embodiment in structure of the vibration insulator 30 but the other structures are the same, differences from the first embodiment are mainly described, and description of members similar to those of the first embodiment is omitted by assigning the same reference signs thereto, for illustrative purposes.

In this embodiment, the distance from the upper surface of a plate bottom section 37 of a plate 32 to an outer surface 12A of a cylinder head 12 is height H12, which is lower than height H11 of the vibration damping member 31. That is, the height between the outer surface 12A of the cylinder head 12 and a shoulder section 18 of an inlet section 17 is set to a height obtained by adding the thickness of the plate 32 to the height H12.

As shown in FIG. 9, the vibration insulator 30 is formed by sequentially stacking the vibration damping member 31 and a tolerance ring 33 on the plate bottom section 37 of the plate 32.

A vibration damping member 31 includes: an elastic member 36D formed of rubber or the like, which is similar to the elastic member 36 described in the first embodiment; and the annular coil spring 34 embedded in the elastic member 36D.

A sleeve section 41A of the tolerance ring 33 is a circular ring-like shape extending from a ring outer circumferential surface 41 toward the outer side of the tolerance ring 33 in the radial direction. A lower surface 41B of the sleeve section 41A is formed as a surface continuing from the ring bottom surface 40. The lower surface 41B of the sleeve section 41A projects toward the outer circumference, and goes over the inlet section 17. The size of the sleeve section 41A in the radial direction is set so that, even when the plate 32 slides on the shoulder section 18 in any direction in the range of 0 to 360 degrees in the radial direction (laterally), the outer circumferential surface of the sleeve section 41A may exist on the outer surface 12A of the cylinder head 12. On this basis, a gap (gap=H11−H12) is ensured between the lower surface 41B of the sleeve section 41A and the outer surface 12A of the cylinder head 12.

The above configuration guarantees that the vibration damping member 31 deforms between the height H11 and the height H12, and the vibration damping member 31 displays suitable vibration damping performance. In other words, when the vibration damping member 31 is deformed and compressed into the height H12 by receiving a high pressing force, the lower surface 41B of the sleeve section 41A abuts the outer surface 12A of the cylinder head 12. Therefore, the vibration damping member 31 is prevented from deforming into a height that is lower than the height H12. That is, deterioration in vibration damping performance of the vibration damping member 31 and plastic deformation of the vibration damping member 31 are prevented.

Additionally, since the stiffness of the tolerance ring 33 as a whole is improved by integration of the sleeve section 41A with the tolerance ring 33, the opening of the upper part of the tolerance ring 33 is prevented from enlarging.

As described above, this embodiment not only brings about advantages that are the same as or similar to the above advantages (1) to (3) and (5) to (7) of the first embodiment described above, but also brings about advantages as listed below.

(12) The stiffness of the tolerance ring 33 is improved also by the sleeve section 41A extending out from the outer circumferential surface of the tolerance ring 33. Therefore, improvement in durability of the tolerance ring 33 against a force that acts on the tolerance ring 33 from the tapered surface 24 of the fuel injection valve 11 to enlarge the opening of the tolerance ring 33 is enabled. Additionally, when the elastic member 36 is deformed into a crushed form, the sleeve section 41A of the tolerance ring 33 abuts the cylinder head 12. Therefore, excessive deformation of the elastic member 36 is restricted, whereby it is made possible to use the elastic member 36 within a range (a height of H11 to H12) that permits elastic deformation thereof. This serves to suitably maintain the elasticity of the elastic member 36 and to maintain the vibration absorption and damping function using the elasticity.

Each of the above embodiments may be modified, for example, in the following modes.

Figure 10:
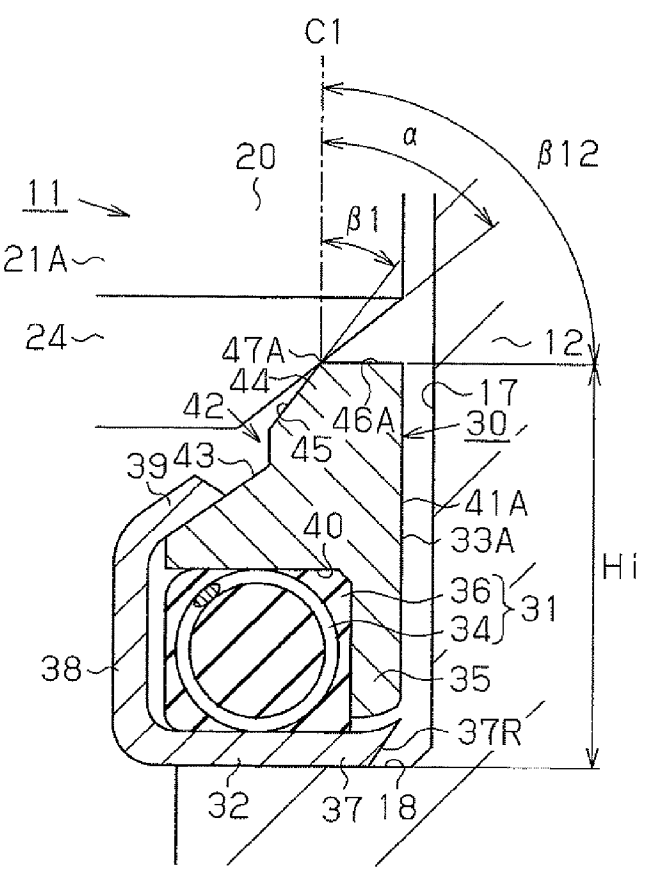
FIG. 10 is an end view showing the structure of an end face of the vibration insulator according to a modification of the first embodiment.
Figure 12:
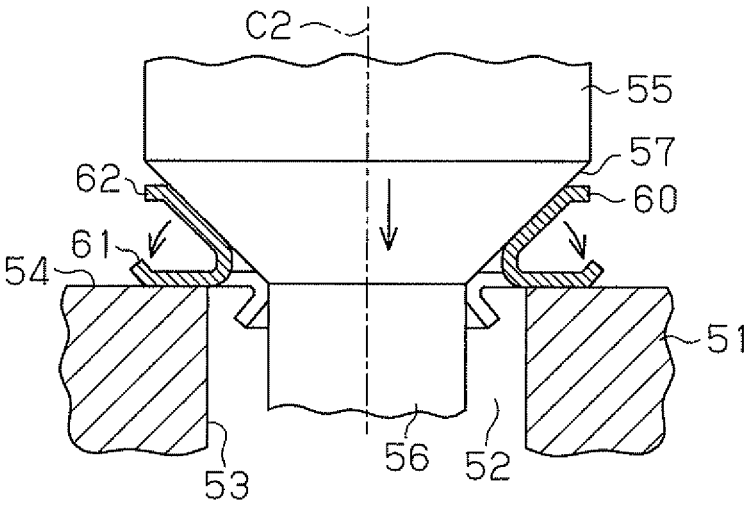
Fig.12(Prior Art)
FIG. 12 is a cross-sectional view showing a cross-sectional structure of a conventional vibration insulator.

Each of the above embodiments shows, as an example, a case where the angle β2 of the outer tapered surface 46 is an angle smaller than 90 degrees with respect to the axis parallel C1. However, the present invention is not limited to such a case, and the angle of the outer tapered surface may be an angle of 90 degrees with respect to the axis parallel C1. For example, as shown in FIG. 10, a ridgeline 47A may be formed by an outer tapered surface 46A and the inner tapered surface 45 with the angle of the outer tapered surface 46A set to the angle β12 of 90 degrees with respect to the shaft parallel center C1. In this case, formation of the outer tapered surface is easier, and flexibility in configuring such a vibration insulator is improved.

Figure 11:
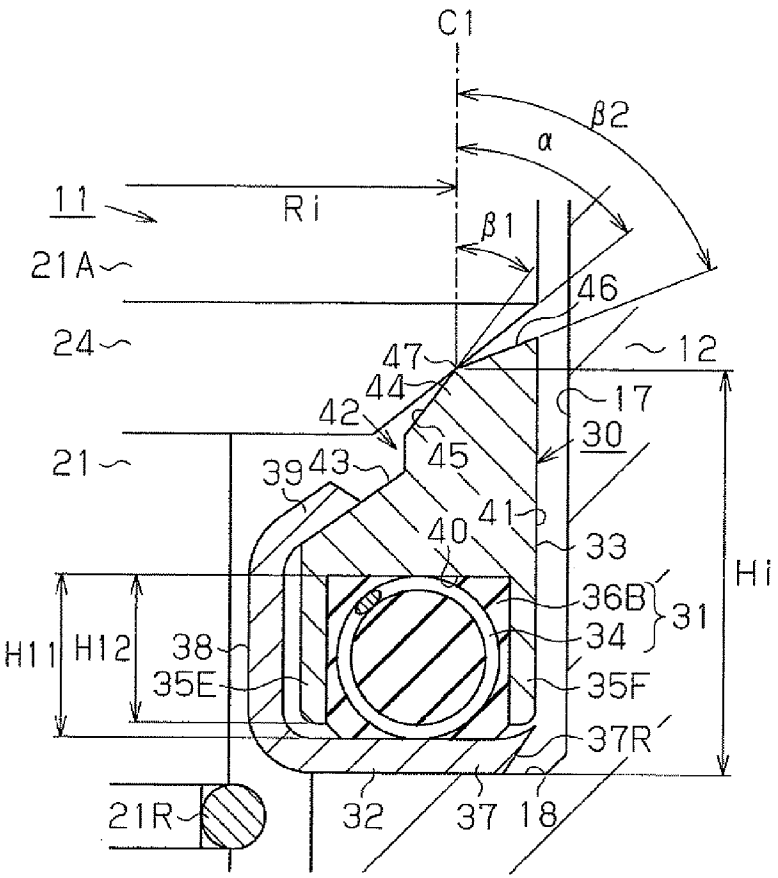
FIG. 11 is an end view showing the structure of an end face of the vibration insulator according to a modification of the third embodiment.

The third embodiment shown in FIG. 7 shows, as an example, a case where a space defined by the inner sleeve section 35B and the outer sleeve section 35C has a cross-sectional shape of a trapezoid. However, the present invention is not limited to such a case, and the thickness of at least any one of the inner sleeve section and the outer sleeve section may be uniform from the ring bottom surface 40 through the distal end toward the plate 32. For example, as shown in FIG. 11, both of an inner sleeve section 35E and an outer sleeve section 35F may have constant thicknesses from the ring bottom surface 40 through the distal end toward the plate 32, respectively. In this case, a reactive force that occurs to the vibration damping member 31 when the vibration damping member 31 is going to deform by being pressed acts as a force that presses back the ring bottom surface 40. Therefore, it is made possible to cancel a part of the force Fa applied to the tolerance ring 33 from the fuel injection valve 11 in the direction along the axis parallel C1. As a result, the height of the vibration damping member 31 is prevented from changing. In other words, the fuel injection valve 11 is prevented from entering into the insertion hole 15 of cylinder head 12 more deeply than necessary, with respect to the ridgeline of the tolerance ring 33. This serves to increase flexibility in configuring the sleeve section, and also to improve flexibility in configuring such a vibration insulator.

Each of the above embodiments shows, as an example, a case where the vibration damping member 31 includes both of the elastic member 36 (or any one of 36A to 36D) and the coil spring 34. However, the present invention is not limited to such a case, and is not limited to a vibration damping member of the exemplified structure. Any vibration damping member having a vibration absorbing and damping function may be used by the application of any vibration damping members formed of elastic materials of various kinds, springs of various kinds or combinations thereof.

Each of FIGS. 1 to 8, that is, the first to fourth embodiments shows, as an example, a case where the coil spring 34 and the sleeve section 35 (or any one of 35A to 35D) are spaced apart from each other. However, the present invention is not limited to such a case, and the coil spring may be configured to stay in contact with or to come in contact with the sleeve section.

An internal combustion engine to which this invention is applied may be either a gasoline engine or a diesel engine as long as the engine is an internal combustion engine of the in-cylinder injection system.

DESCRIPTION OF THE REFERENCE NUMERALS

10 fuel injection system
11 fuel injection valve
12 cylinder head
12A outer surface
12B inner surface
13 delivery pipe
14 fuel injection valve cup
14A inner circumferential surface
15 insertion hole
16 distal end hole section
17 inlet section
18 shoulder section
19 medium hole section
20 large diameter section
21 medium diameter section
21R ring
22 small diameter section
23 injection nozzle
24 tapered surface
25 sealing section
26 proximal relay section

26J connector
27 proximal insertion section
28 proximal sealing section
30 vibration insulator
31 vibration damping member
32 plate
33 tolerance ring
34 coil spring
35, 35A, 35D sleeve section
35B, 35E inner sleeve section
35C, 35F outer sleeve section
36, 36A, 36B, 36C, 36D elastic member
37 plate bottom section
37R burr section
38 plate inner wall section
39 plate cover section
40 ring bottom surface
41 ring outer circumferential surface
41A sleeve section
41B lower surface
42 inner circumferential sloping surface
43 joint section
44 abutting section
45 inner tapered surface
46, 46A outer tapered surface
47, 47A ridgeline

The invention claimed is:

1. A vibration insulator for a fuel injection valve, the vibration insulator damping vibration that occurs to the fuel injection valve, wherein the fuel injection valve is mounted on a cylinder head while being inserted into an insertion hole provided in the cylinder head, a shoulder section is annularly formed at an inlet portion of the insertion hole in a widening manner, the fuel injection valve includes a stepped section, a diameter of which is enlarged in a tapered manner so that the stepped section has a tapered surface facing the shoulder section, the vibration insulator is located between the stepped section and the shoulder section, the vibration insulator includes a circular ring-like tolerance ring abutting the tapered surface and an elastic member arranged between the tolerance ring and the shoulder section, wherein, in order to perform damping of vibration that occurs to the fuel injection valve, the elastic member is formed in a circular ring-like shape corresponding to the bottom surface of the tolerance ring, the tolerance ring has a circular ring-like sleeve section formed integrally therewith in a manner extending from a surface of the tolerance ring that faces away from the tapered surface, the sleeve section having a circular ring-like shape that is concentric with the tolerance ring, the sleeve section extends from the bottom surface of the tolerance ring toward the shoulder section along the elastic member, and the distance between an end of the sleeve section in the extending direction and the shoulder section is formed to have a length that maintains elastic deformation of the elastic member when the elastic member is deformed in the extending direction of the sleeve section.

2. The vibration insulator for a fuel injection valve according to claim 1, wherein a coil spring helically arranged in a manner corresponding to the circular ring-like shape of the elastic member is embedded in the elastic member, and the extending length of the sleeve section is shorter than the diameter of the helix of the coil spring.

3. The vibration insulator for a fuel injection valve according to claim 1, wherein the sleeve section is provided toward the outer circumference of the elastic member.

4. The vibration insulator for a fuel injection valve according to claim 3, wherein a surface of the sleeve section that faces the elastic member is formed into a shape that follows the external form of the helix of the coil spring.

5. The vibration insulator for a fuel injection valve according to claim 1, wherein the sleeve section is provided toward each of the inner circumference and the outer circumference of the elastic member.

6. The vibration insulator for a fuel injection valve according to claim 5, wherein the distance between the inner circumferential sleeve section and the outer circumferential sleeve section is set to become wider toward the shoulder section from the bottom surface of the tolerance ring.

7. The vibration insulator for a fuel injection valve according to claim 1, wherein the sleeve section is provided toward the inner circumference of the elastic member.

8. A vibration insulator for a fuel injection valve, the vibration insulator damping vibration that occurs to the fuel injection valve, wherein the fuel injection valve is mounted on a cylinder head while being inserted into an insertion hole provided in the cylinder head, a shoulder section is annularly formed at an inlet portion of the insertion hole in a widening manner, the fuel injection valve includes a stepped section, the diameter of which is enlarged in a tapered manner so that the stepped section has a tapered surface facing the shoulder section, the vibration insulator is located between the stepped section and the shoulder section, the vibration insulator includes a circular ring-like tolerance ring abutting the tapered surface and an elastic member arranged between the tolerance ring and the shoulder section, wherein, in order to perform damping of vibration that occurs to the fuel injection valve, the elastic member is formed in a circular ring-like shape corresponding to the bottom surface of the tolerance ring, the tolerance ring has a circular ring-like sleeve section formed integrally therewith in a manner extending from a surface of the tolerance ring that faces away from the tapered surface, the sleeve section having a circular ring-like shape that is concentric with the tolerance ring, the sleeve section is extended out to a position facing the surface of the cylinder head that has the insertion hole opened therein, and the elastic member provides a distance between the sleeve section and the surface of the cylinder head such that elastic deformation of the elastic member is maintained when the elastic member is deformed.

9. The vibration insulator for a fuel injection valve according to claim 1, further comprising a metal plate having a circular ring-like portion located between the elastic member and the shoulder section, wherein the metal plate is formed to pinch the tolerance ring and the elastic member together from the inner circumference of the tolerance ring.

10. The vibration insulator for a fuel injection valve according to claim 9, wherein the outer circumferential edge of the metal plate is molded into a shape having a burr generated thereon, the burr having been cut upward toward the elastic member.

11. The vibration insulator for a fuel injection valve according to claim 1, wherein the tolerance ring is formed of metal having the same level of hardness as a housing of the fuel injection valve.

* * * * *